US009432772B2

(12) United States Patent
Davis

(10) Patent No.: US 9,432,772 B2
(45) Date of Patent: Aug. 30, 2016

(54) METHODS AND APPARATUS FOR PORTING LOUDSPEAKERS TO AN EARPIECE

(71) Applicant: Google Technology Holdings LLC, Mountain View, CA (US)

(72) Inventor: Giles T. Davis, Mundelein, IL (US)

(73) Assignee: Google Technology Holdings LLC, Mountain View, CA (US)

( * ) Notice: Subject to any disclaimer, the term of this patent is extended or adjusted under 35 U.S.C. 154(b) by 344 days.

(21) Appl. No.: 13/671,673

(22) Filed: Nov. 8, 2012

(65) Prior Publication Data

US 2014/0126757 A1 May 8, 2014

(51) Int. Cl.

| | |
|---|---|
| ***H04R 5/02*** | (2006.01) |
| ***H04R 1/20*** | (2006.01) |
| ***H04R 5/033*** | (2006.01) |
| ***H04R 3/12*** | (2006.01) |
| ***H04R 5/04*** | (2006.01) |
| *H04R 1/28* | (2006.01) |

(52) U.S. Cl.

CPC ..... *H04R 5/033* (2013.01); *H04R 3/12* (2013.01); *H04R 5/02* (2013.01); *H04R 5/04* (2013.01); *H04R 1/2819* (2013.01); *H04R 2499/11* (2013.01)

(58) Field of Classification Search

CPC .... H04R 1/28; H04R 1/2803; H04R 1/2815; H04R 1/2819; H04R 1/2823; H04R 1/2826; H04R 3/12; H04R 5/033; H04R 2499/11

USPC ..... 381/89, 94, 340, 341, 342, 345, 386, 381/335, 337, 357, 391, 84, 85, 99, 1, 24, 381/160, 161, 162, 304, 338, 339, 358, 381/382; 455/569.1, 550.1, 575.2; 361/814

See application file for complete search history.

(56) References Cited

U.S. PATENT DOCUMENTS

| | | | | |
|---|---|---|---|---|
| 5,832,079 | A | 11/1998 | Rabe | |
| 6,411,828 | B1 * | 6/2002 | Lands | H04M 1/605 379/388.01 |
| 7,343,181 | B2 | 3/2008 | Chan et al. | |
| 2004/0264727 | A1 * | 12/2004 | Kim | H04R 1/2819 381/370 |
| 2007/0019820 | A1 | 1/2007 | Zurek et al. | |
| 2009/0003639 | A1 * | 1/2009 | Aylward | H04R 1/2857 381/349 |
| 2009/0129623 | A1 | 5/2009 | Weckstrom et al. | |
| 2011/0026720 | A1 * | 2/2011 | Ohta | H04S 5/005 381/17 |
| 2014/0086415 | A1 * | 3/2014 | Sim | G06F 1/1688 381/17 |

* cited by examiner

*Primary Examiner* — Vivian Chin
*Assistant Examiner* — William A Jerez Lora
(74) *Attorney, Agent, or Firm* — Brake Hughes Bellermann LLP

(57) ABSTRACT

A hand-held electronic device includes an earpiece, a first speaker having a first primary audio output ported to the earpiece, a second speaker having a second primary audio output and a second bass reflex output, with the second bass reflex audio output also being ported to the earpiece. The device includes a use case manager configured to determine a mode of operation of the device, and a controller configured to drive the first and second speakers in either a broadcast mode or a private mode in response to a signal from the use case manager. The polarity of the signal driving the second speaker is inverted for frequencies below the bass reflex port resonance frequency, to thereby provide a higher total combined energy in the vicinity of port resonance.

16 Claims, 9 Drawing Sheets

METHODS AND APPARATUS FOR PORTING LOUDSPEAKERS TO AN EARPIECE

TECHNICAL FIELD

The technical field relates generally to methods and apparatus for configuring loudspeakers and their associated bass reflex outputs for use with a telephone handset, and more particularly to porting primary and bass reflex loudspeaker output to an earpiece.

BACKGROUND

Consumers increasingly desire to listen to telephone conversations through a private mode earpiece, and to otherwise view and listen to media on a variety of devices, such as mobile telephone handsets, gaming consoles, ebooks, MP3 and other audiovisual display and playback devices, personal digital assistants (PDAs), and numerous other computing and telecommunication devices.

BRIEF DESCRIPTION OF THE DRAWING FIGURES

The present disclosure will hereinafter be described in conjunction with the following drawing figures, wherein like numerals denote like elements, and wherein.

DETAILED DESCRIPTION

Figure 1:
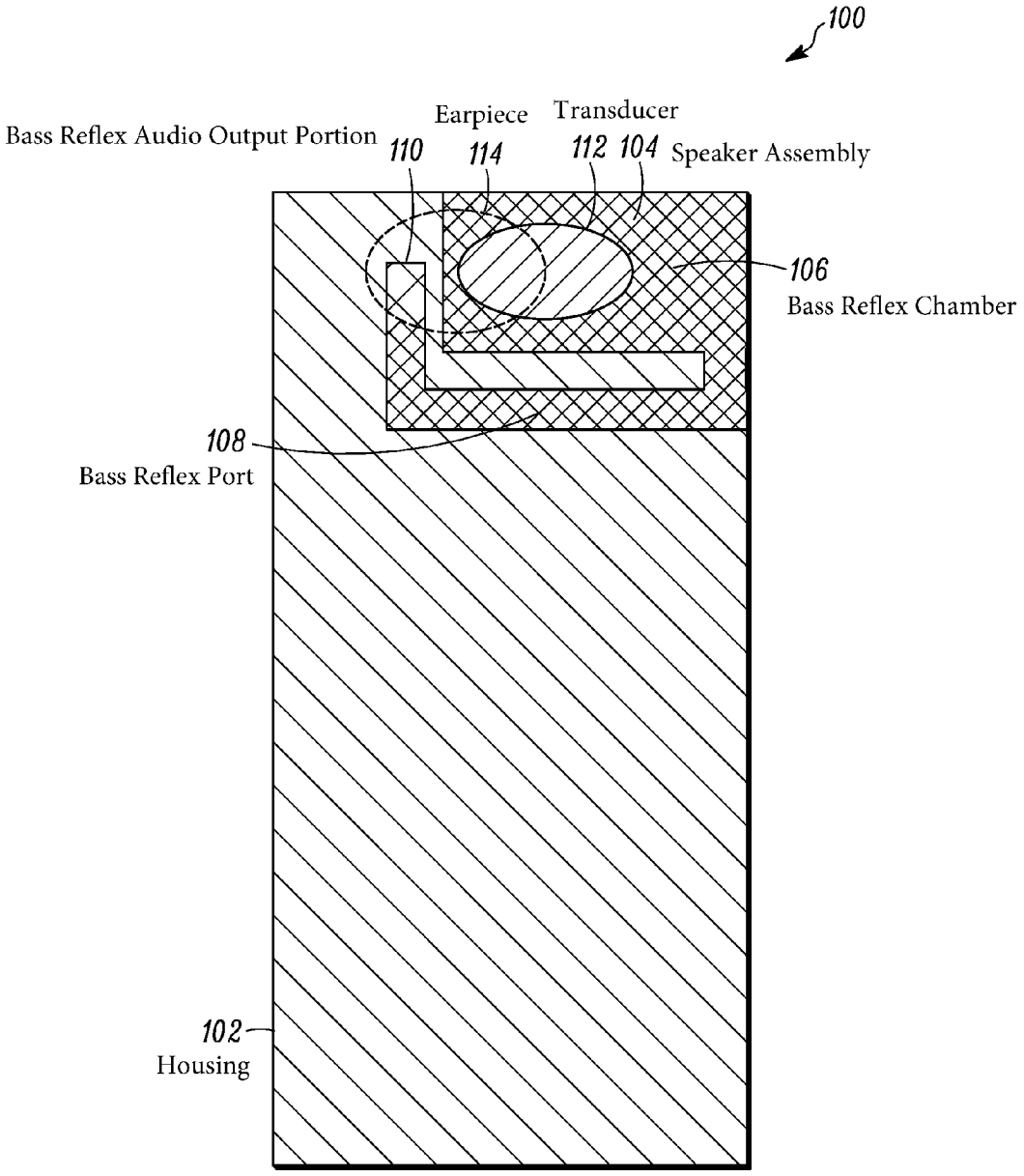
FIG. 1 is a schematic diagram of a telephone handset including a speaker having a primary output and a bass reflex output ported to an earpiece in accordance with an exemplary embodiment.

The following detailed description is merely exemplary in nature and is not intended to limit the application and uses of the wearable device described herein. Furthermore, there is no intention to be bound by any theory presented in the preceding background or the following detailed description.

Broadly, exemplary embodiments disclosed herein provide systems and methods for porting loudspeakers to an earpiece in a telephone handset. A hand-held electronic device is provided which includes an earpiece, a first speaker having a first primary audio output ported to the earpiece, and a second speaker having a second primary audio output and a second bass reflex output, wherein the second bass reflex audio output is also ported to the earpiece. A "use case manager" decides how the audio configured based on what is being played back. The use case management module may be configured to respond to user action: for example, if the user answers or places a call, the use case manager can select private mode unless the user selects speaker mode for the call. If, on the other hand, the user launches a video or an audio file, the use case management module can select landscape (broadcast) mode.

In an embodiment, the device has a first region and a second region remote from the first region and the first speaker includes a first bass reflex audio output. The first primary audio output is disposed proximate the second bass reflex audio output in the first region, the second primary audio output is disposed proximate the first bass reflex audio output in the second region, and the earpiece is disposed in the first region.

In another embodiment, the speaker volume in broadcast mode is substantially louder than the speaker volume in private mode. Broadcast mode may be monophonic or stereophonic, and private mode is preferable monophonic.

A display such as a flat screen video monitor may be positioned disposed between the first and second regions, such that the first position corresponds to a landscape viewing mode and the second position corresponds to a telephone mode (or private mode) of operation. The sensor may be a motion sensor such as an accelerometer.

In a further embodiment, the first speaker system includes a first audio transducer and the second speaker system includes a second audio transducer; the first primary audio output is located on an output side of the first audio transducer and a first volume portion is located on a reflex side of the first audio transducer; the second primary audio output is located on an output side of the second audio transducer and a second volume portion is located on a reflex side of the second audio transducer; the first bass reflex audio port is connected to the first volume portion through a first port extending from the first region to the second region; and the second bass reflex audio port is connected to the second volume portion through a second port extending from the first region to the second region.

In an embodiment, a shutter may be configured to block the first bass reflex output when the device is in broadcast mode. The shutter may be an electronic switch or, alternatively, a manually actuable (e.g., slidable) mechanism.

The controller may include a filter and a polarity inverter, and the controller may be configured to apply a first signal to the first speaker and a second signal to the second speaker. In one embodiment, the controller is configured to: apply the first and second signals in phase to the first and second speakers, respectively, for all frequencies when the device is operating in said broadcast mode; apply the first and second signals in phase for all frequencies above a predetermined threshold when the device is operating in private mode; and apply the first and second signals out of phase to the first and second speakers, respectively, for all frequencies below the predetermined threshold when the device is operating in private mode.

In one embodiment, the predetermined threshold generally corresponds to the resonant frequency of the first and second bass reflex outputs, which may be in the range from about 200 to about 400 Hertz, and particularly about 300 Hertz.

In a further embodiment, a handset includes an earpiece; a first speaker having a primary output ported to the earpiece; a second speaker having a bass reflex output ported to the earpiece and tuned to a resonance frequency; and a controller configured to apply a signal to the second speaker, the signal having a high frequency component at a first phase and a low frequency component at a second phase. In a preferred embodiment, the high frequency component is above the resonance frequency and the low frequency component is below the resonance frequency, wherein the resonance frequency may be in the range of about 300 Hertz. A filter may be employed to limit the signal to within the range of the resonance frequency.

In yet a further embodiment, a method of porting audio signals to an earpiece of a telephone operating in private mode is provided. The method includes applying a primary audio output of a first speaker to the earpiece; applying a bass reflex audio output of a second speaker to the earpiece; applying a first electronic signal to the first speaker; and applying a second electronic signal to the second speaker, wherein the second electronic signal has a first frequency component at a first phase, and a second frequency component at a second phase which is inverted with respect to the first phase. In this way, the primary output of the first speaker and the bass reflex output of the secondary speaker are in phase throughout the frequency range of interest for both speakers. The method may also involve blocking a bass reflex output of the first speaker.

FIG. 1 is a schematic diagram representation of a telephone handset 100 including a speaker having both a primary output and a bass reflex output ported to an earpiece in accordance with an exemplary embodiment. Although exemplary embodiments are discussed below with reference to hand-held and portable electronic devices, the systems and methods discussed herein are equally applicable to any type of device having one or more speakers and an earpiece.

In the embodiment shown in FIG. 1, handset 100 includes a housing 102 enclosing a speaker assembly 104. Speaker assembly 104 includes a transducer 112 (such as, for example, an acoustic diaphragm), a bass reflex chamber 106, a bass reflex port (conduit) 108, and a bass reflex audio output portion 110. Transducer 112 produces a primary audio output on one side (out of the page in FIG. 1) and a bass reflex output on the opposite side (into the page in FIG. 1). The bass reflex output is produced by a tuned combination of chamber 106 and port 108.

In particular, the air volume within chamber 106 functions as a mechanical spring and the air volume within port 108 functions as a movable mass; together, chamber 106 and port 108 may be modeled as a mass/spring combination, as is known in the art. The bass reflex output terminates at an open end of port 108, namely, bass reflex audio output portion 110. In the embodiment shown in FIG. 1, bass reflex audio output portion 110 and the primary audio output from the front side of speaker 104 are both routed (ported) into an earpiece 114 configured to be held against the user's ear during private mode use, that is, when device 100 is operated as a telephone handset.

The geometric configuration of the bass reflex output system described above may be "tuned"—or optimized—to provide desired frequency response characteristics from the combined outputs of the primary and bass reflex outputs from speaker 104. More particularly, the various components may be configured such that the resonance frequency of the combined primary/bass reflex outputs is in the range of 100-450 Hertz, and particularly around 250-350 Hertz, and preferably about 300 Hertz.

Figure 2:
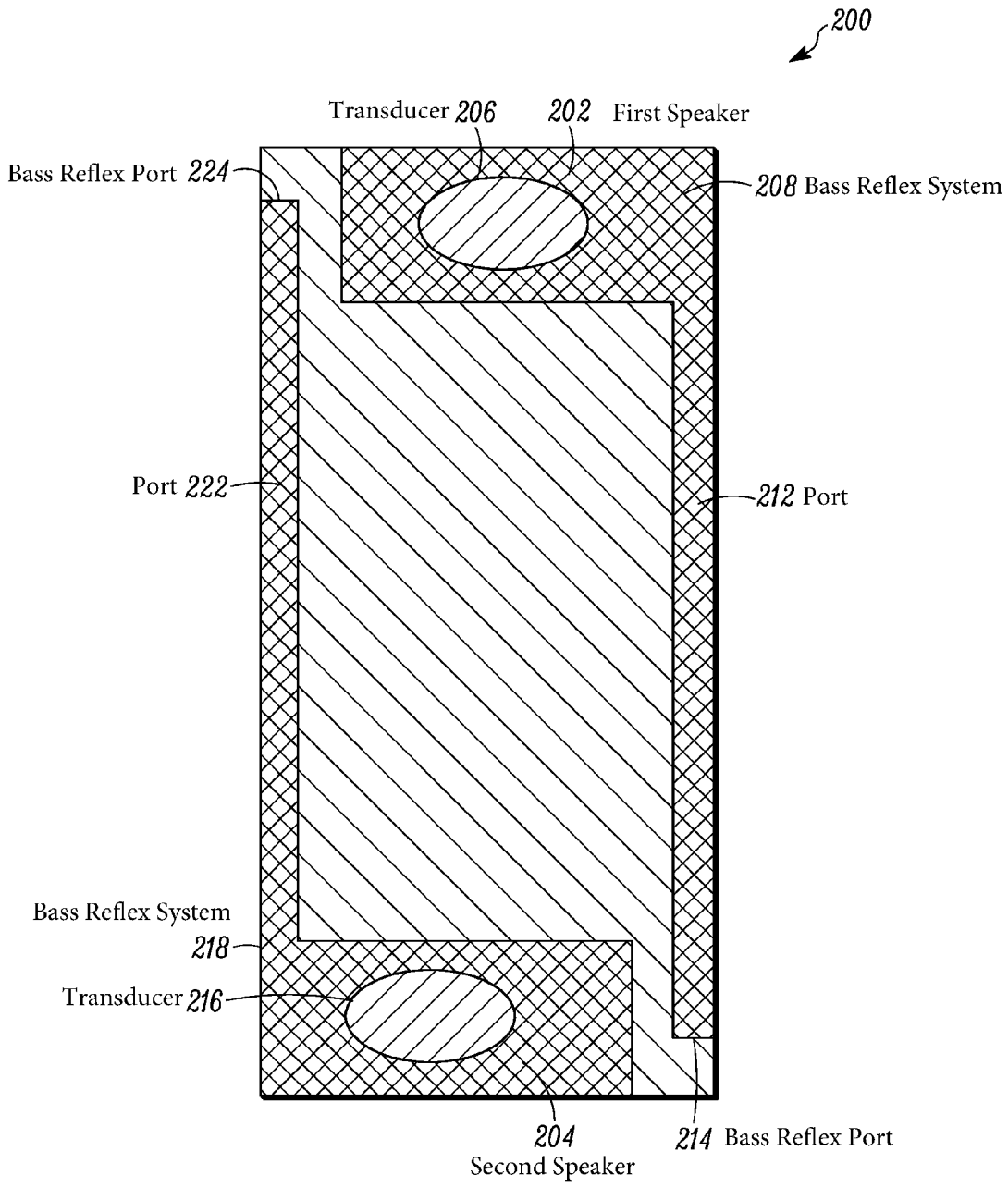
FIG. 2 is a schematic diagram of dual loudspeakers in bass reflex enclosures at opposite ends of a telephone to support landscape stereo mode in accordance with an exemplary embodiment.

FIG. 2 is a schematic diagram of a handset 200 including first and second speakers 202, 204, respectively, in bass reflex enclosures at opposite ends of the handset to support landscape stereo mode. Speaker 202 includes a transducer 206 and a bass reflex system 208 having a chamber and a port 212 extending from the chamber and terminating at a bass reflex port 214. Speaker 204 includes a transducer 216 and a bass reflex system 218 having a chamber and a port 222 extending from the chamber and terminating at a bass reflex port 224. As shown in FIG. 2, the bass reflex port of one speaker is configured to terminate near the primary output of the opposing speaker.

With continued reference to FIG. 2, in one embodiment the two speaker systems/porting systems may be symmetrical; that is, the speakers are identical and disposed at opposite ends of the device for broadcast use, such as, for example, when the device is used for playing music, videos, and the like.

Figure 3:
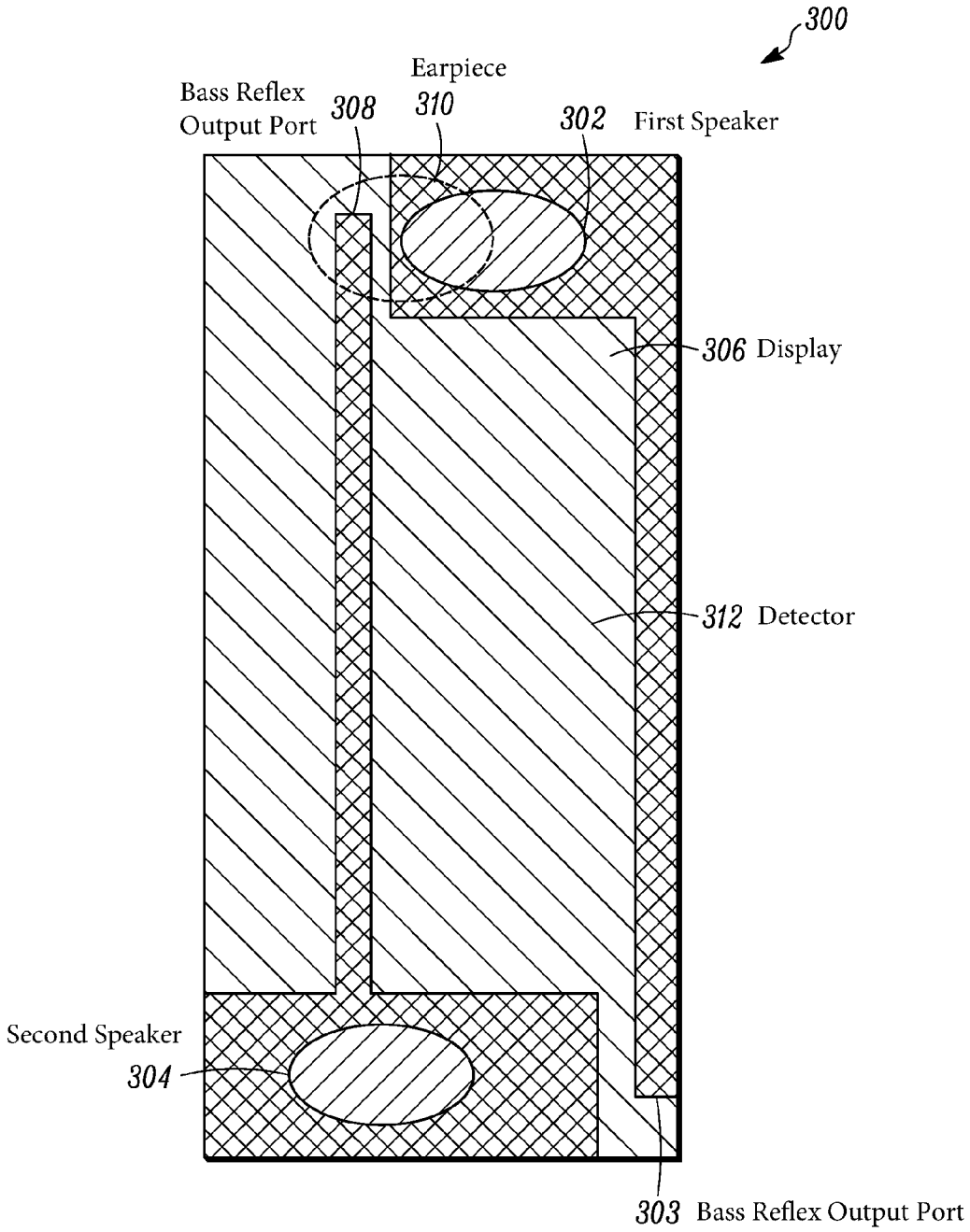
FIG. 3 is a schematic diagram illustrating the active port of the top speaker and the bass reflex port of the bottom speaker ported to the earpiece in accordance with an exemplary embodiment.

Referring now to FIG. 3, a schematic diagram similar to that of FIG. 2 illustrates a novel porting architecture wherein the active (primary) port of the top speaker and the bass reflex port of the bottom speaker are both ported to the earpiece.

More particularly, a handset 300 includes first and second speakers 302, 304, respectively, an earpiece 310, a screen display and/or touch screen monitor 306 for viewing text, images, graphics, and/or video, and a sensor (detector) 312 (or a use case management module) for determining whether a horizontal/landscape or vertical/telephone mode of operation is desired. First speaker 302 includes a bass reflex output port 303 terminating near second speaker 304. Second speaker 304 includes a bass reflex output port 308 which terminates near first speaker 302. The primary audio output of first speaker 302, as well as the bass reflex output port 308 of second speaker 304, are both ported to earpiece 310.

With continued reference to FIG. 3, when sensor 312 detects that handset 300 should be used in a landscape mode (e.g., a substantially horizontal orientation), first and second speakers 302, 304, may be symmetrically operated at a relatively high volume (sometimes referred to herein as "broadcast" mode) such that the user can conveniently hear the audio output from a distance (e.g., at an arm's length). Conversely, when detector 312 determines that it is appropriate to drive the audio for telephone use (e.g., a substantially vertical orientation), the speakers may be operated at a relatively low volume referred to herein as private mode. In private mode, the primary audio output of first speaker 302 and the bass reflex audio output 304 are simultaneously ported to earpiece 310.

Notably, either or both speakers can be operated in stereophonic or monophonic mode when the device is operated in broadcast mode, and either or both speakers can be operated in stereophonic or monophonic mode when the device is operated in private mode. Moreover, either or both of the bass reflex ports can be blocked or unblocked in both broadcast and private modes, as desired.

Figure 4:
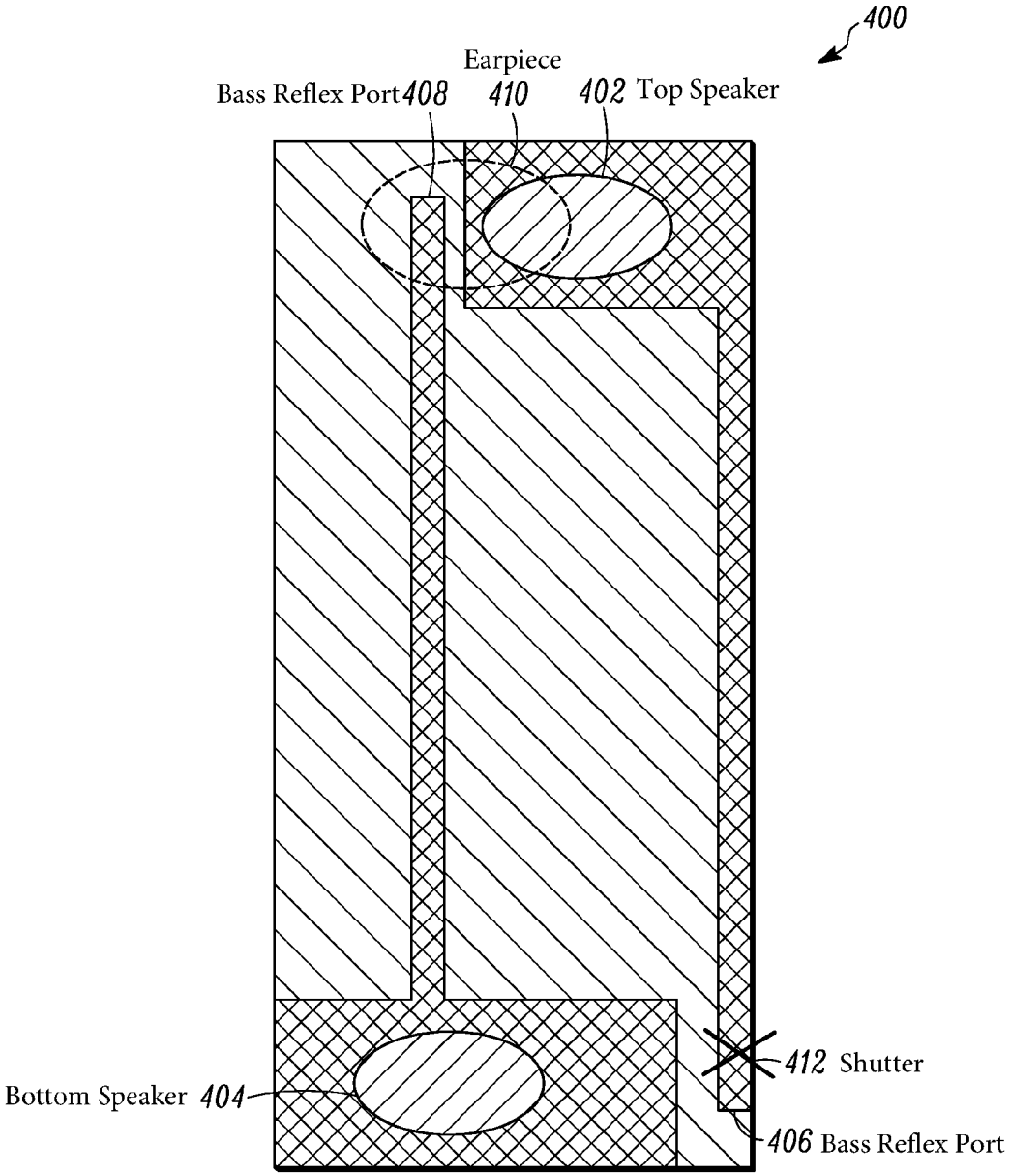
FIG. 4 is a schematic diagram illustrating the handset of FIG. 3 with the top speaker bass reflex port blocked in accordance with an exemplary embodiment.

Referring now to FIG. 4, a handset 400 includes a top speaker 402 having a bass reflex port 406, a bottom speaker 404 having a bass reflex port 408, and an earpiece 410. The primary audio output of top speaker 402 and the bass reflex output from bottom speaker 404 are ported to earpiece 410. The handset configuration of FIG. 4 differs from that of FIG. 3, however, in that bass reflex port 406 may be selectively blocked, for example, through the use of a shutter 412. Shutter 412 may be a mechanical shutter, switch, or the like, and may be manually or electronically actuated to shut off bass reflex port 406.

Figure 5:
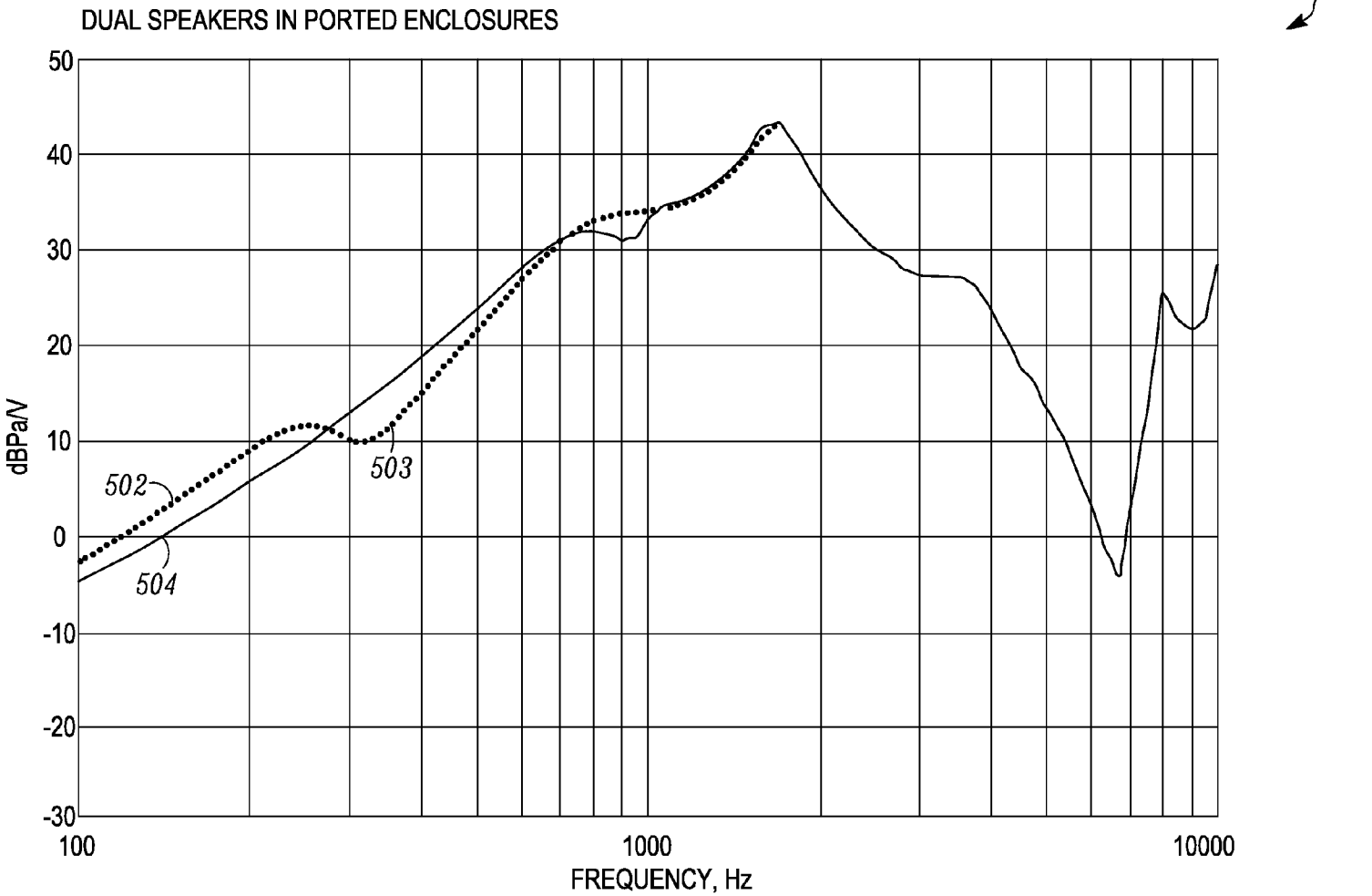
FIGS. 5-8 are graphs plotting speaker output versus frequency for various configurations of dual speakers in ported enclosures in accordance with exemplary embodiments.

FIGS. 5-8 are graph plotting speaker output versus frequency for various configurations of dual speakers in ported enclosures. With particular reference to FIG. 5, a dashed line 502 represents the output of top speaker 402 with its bass reflex port 406 unblocked, and without contribution from bass reflex port 408. The 'dip' (corresponding to a local minimum 503) near 300 Hertz represents reduced diaphragm movement at the resonance frequency of the bass reflex port (typically in the range of 300 Hertz for cellular telephones). A solid line 504 represents the output of speaker 402 with its bass reflex port blocked. As shown in FIG. 5, blocking the bass reflex port has the effect of smoothing the speaker output near the bass reflex resonance frequency.

Figure 6:
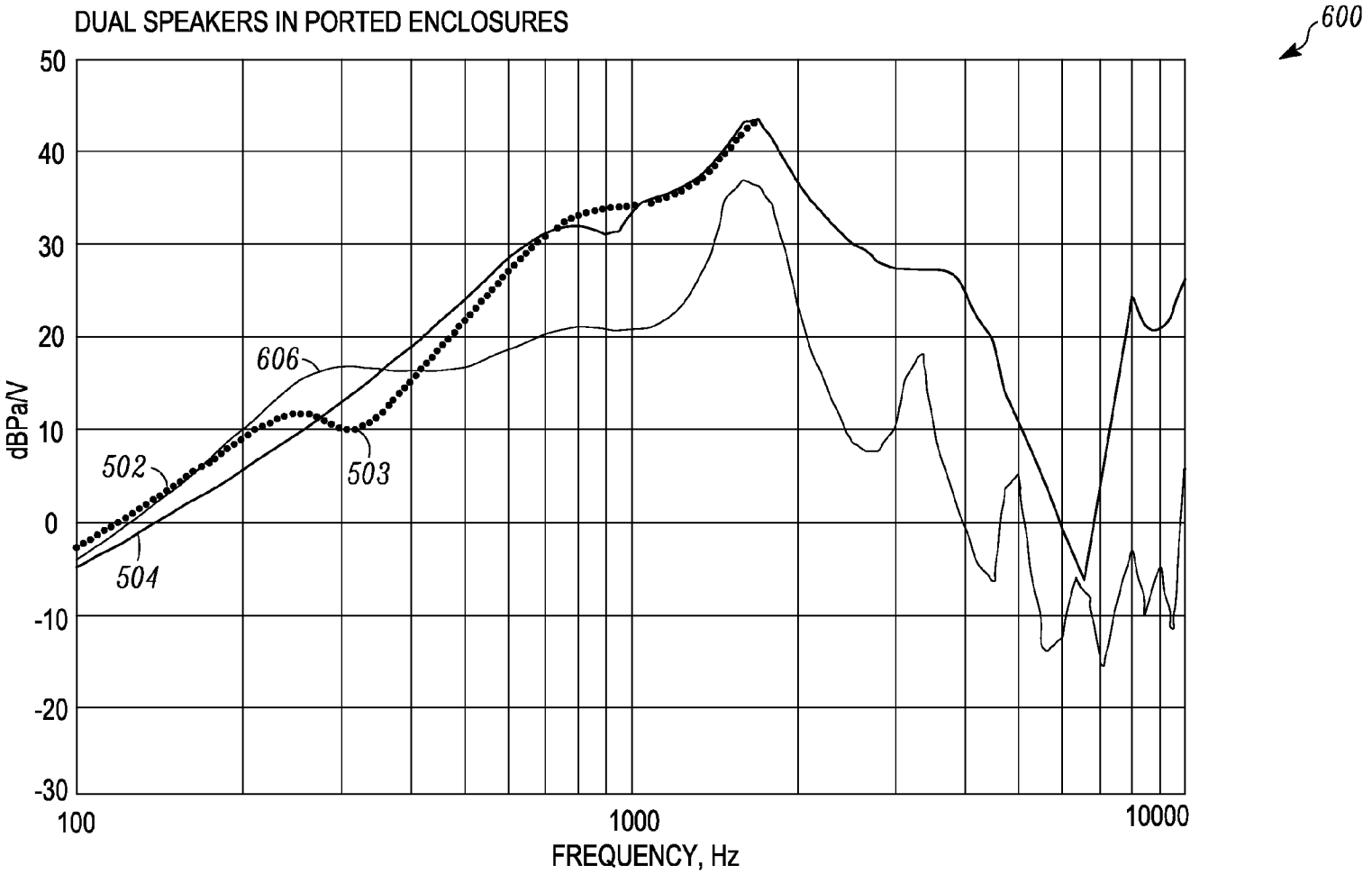

FIG. 6 is a graph 600 which is substantially identical to FIG. 5, but with the addition of a line 606 representing the contribution (in the vicinity of earpiece 410) from bass reflex port 408. Note the increased energy available from bass reflex port 408 near 300 Hertz.

Figure 7:
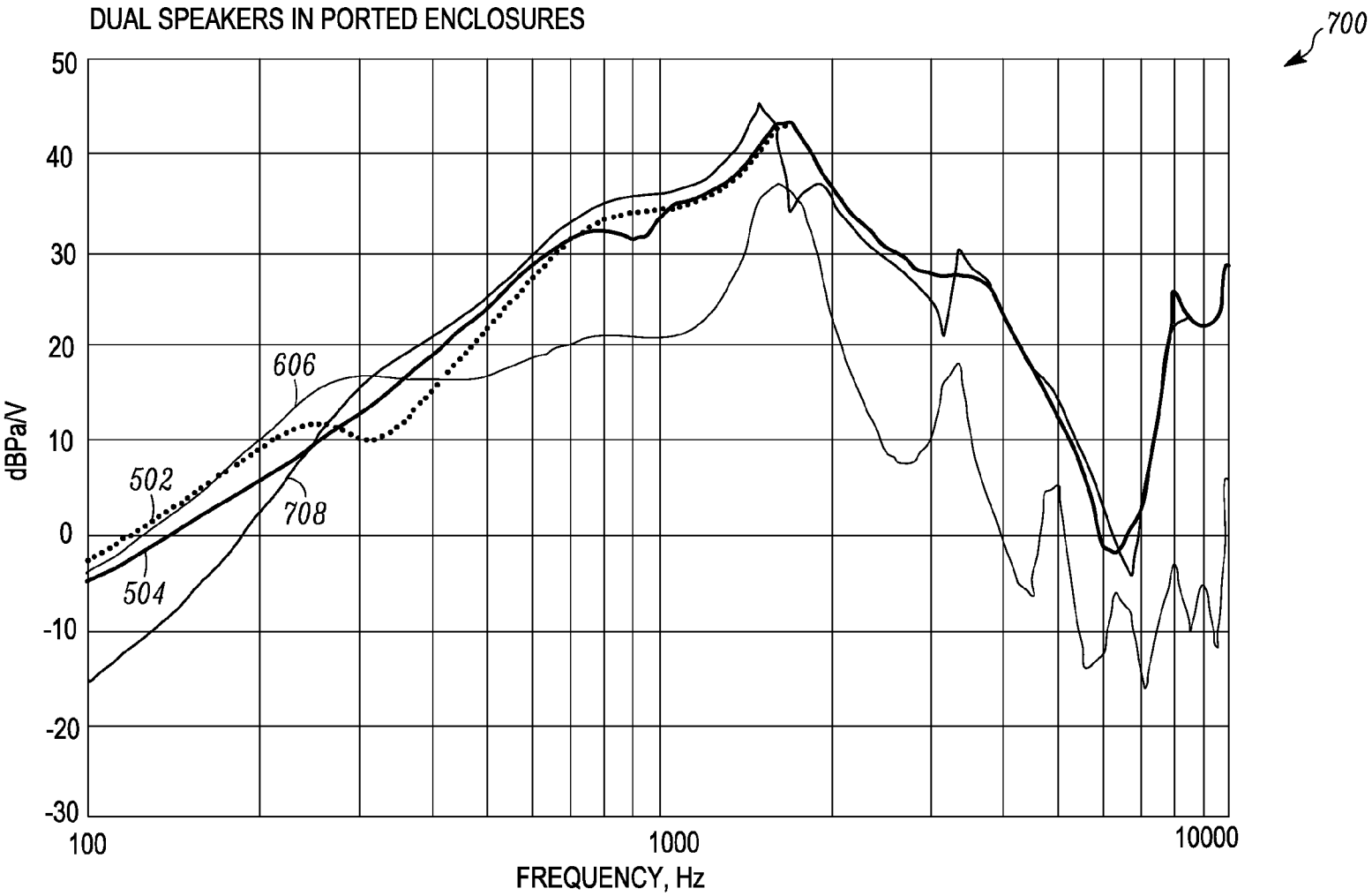

FIG. 7 is a graph 700 which is substantially identical to FIG. 6, but with the addition of a line 708 representing the addition (in the vicinity of earpiece 410) of lines 504 and 606; that is, line 708 corresponds to the summation of: i) the primary audio output of speaker 402 with its bass reflex port 406 blocked; and ii) the contribution from bass reflex port 408 (in the vicinity of earpiece 410). Observe that the summation (line 708) yields more energy at port resonance (around 300 Hertz) and above, but that below 300 Hertz the summation exhibits a reduced total energy. This is due to the relative phase of the bass reflex port (408) contribution vis-à-vis the primary output of speaker 402.

Figure 8:
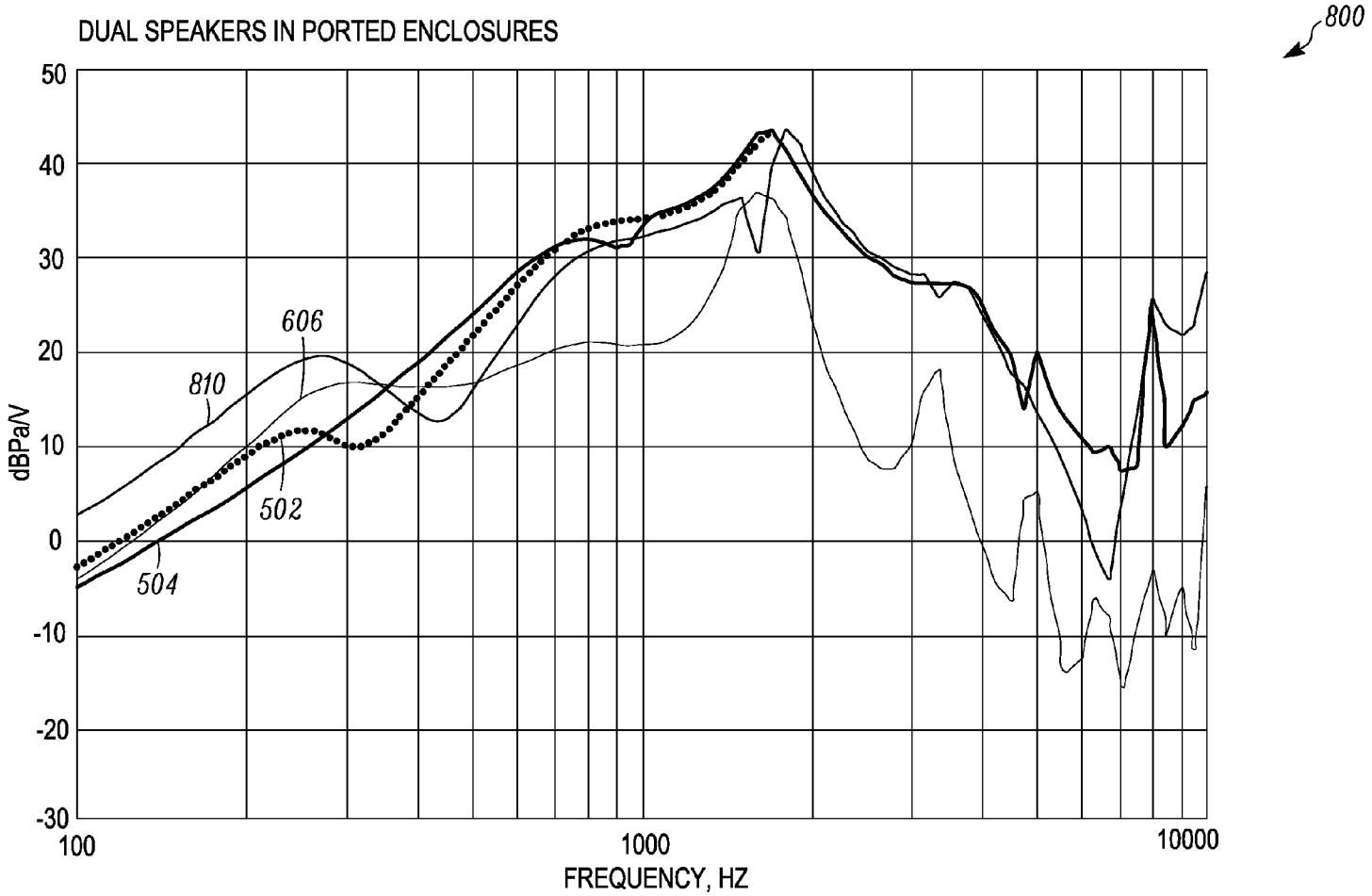

Turning now to FIG. 8, a graph 800 is substantially identical to FIGS. 6 and 7, but with the addition of a line 810 in lieu of line 708. Line 810 represents the summation of the primary output of speaker 402 (with its bass reflex port 406 blocked) and the contribution from bass reflex port 408, but with the signal polarity of speaker 404 (and, hence, port 408) reversed. As a result of the inverted polarity of port 408 vis-à-vis speaker 402, the combination (summation) of lines 504 and 606 below 300 Hertz is greater than either speaker 402 or port 408 alone. Above 300 Hertz, however, line 810 (the summation with reversed polarity) is less than line 708 (summation with the same polarity).

With continued reference to FIGS. 7 and 8, by reversing the relative polarity of speakers 402 and 404 below the port resonance frequency (e.g., in the range of 300 Hertz), but maintaining the same polarity above port resonance, the combined energy near earpiece 410 is greater than each respective contribution for frequencies ranging from 100 Hertz to 1 Kilohertz and above.

Figure 9:
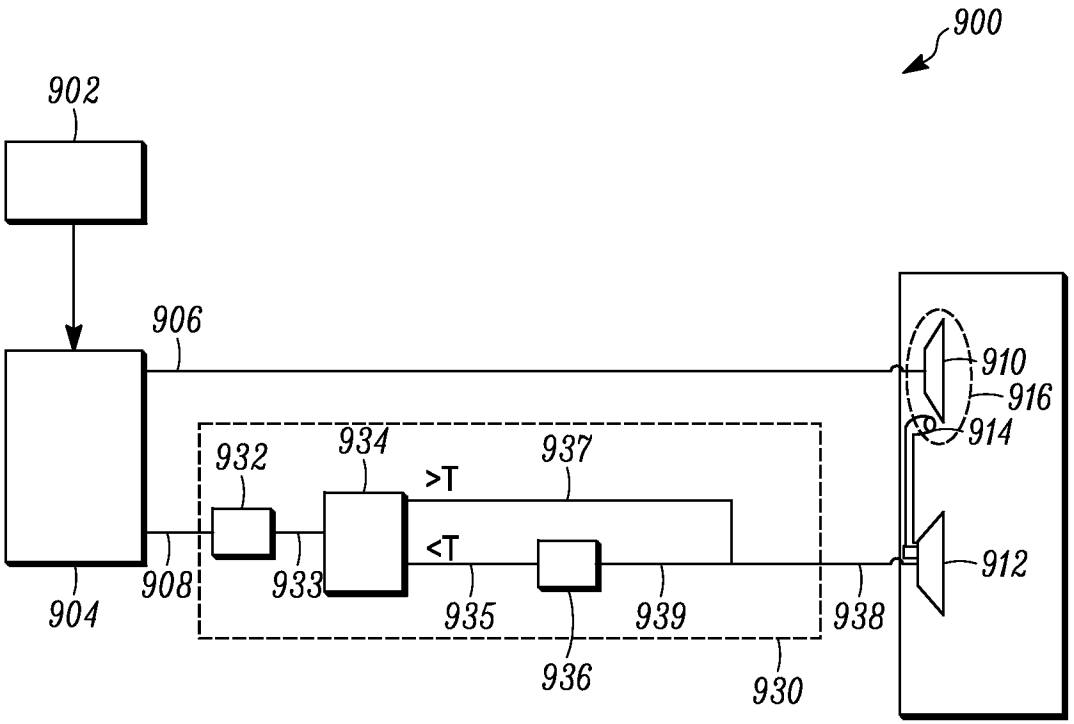
FIG. 9 is a schematic block diagram of a signal processing architecture for use with dual speakers in ported enclosures in accordance with exemplary embodiments.

FIG. 9 is a schematic block diagram of a signal processing architecture for use with dual speakers in ported enclosures in accordance with exemplary embodiments. More particularly, a processing architecture 900 includes a detector 902 (analogous to use case management module 312 in FIG. 3), an amplifier 904, and a control module 930. Processing architecture 900 includes a first speaker 910 (analogous to top speaker 402 in FIG. 4) and a second speaker 912 (analogous to bottom speaker 404 in FIG. 4) having a bass reflex port 914 (analogous to port 408 in FIG. 4). For clarity, the bass reflex port is omitted from FIG. 9 for speaker 910. In the illustrated embodiment, the primary audio output of speaker 910 and the bass reflex audio output from port 914 may both be ported (routed) to an earpiece 916 when the handset is operated in private mode.

Detector 902 is configured to determine whether the audio should be driven in landscape mode or telephone mode. Detector 902 may be configured to apply a signal 903 to amplifier 904 to indicate the mode of operation of the device. Amplifier 904 outputs a first drive signal 906 corresponding to first speaker 910, and a second drive signal 908 corresponding to second speaker 912. Depending on the value of signal 903, amplifier may generate signals 906, 908 at a relatively high volume level (broadcast mode) or a relatively low volume level (private mode).

In order to implement the polarity reversal discussed above in conjunction with FIGS. 7 and 8, second speaker signal 908 is applied to control module 930. More particularly, control module 930 includes a filter 932, for example, a low pass or band pass filter, a frequency detector or band splitter 934, and an all pass or phase shifting circuit 936 which may be implemented via an IIR filter to invert phase of the port output so as to match the phase of the primary speaker. In operation, and particularly during private mode, filter 932 may be configured to generate a signal 933 which is a band limited version of signal 908.

In one embodiment, signal 933 may be narrowly limited to the frequency range surrounding the bass port resonance frequency of speaker 912, e.g., about 100 to 450 Hertz, and preferably about 250 to 350 Hertz. Splitter 934 may be implemented as a combination high pass and low pass filter, such that filter 934 outputs a signal 937 representing the component of signal 908 above a threshold value T (corresponding to port resonance), and a signal 935 representing the component of signal 908 below threshold value T. Inverter 936 may be configured to invert the phase of signal 935 relative to the phase of signal 937, and to output an inverted signal 939 as discussed above. Both the high frequency component (signal 937) and the inverted low frequency component (signal 939) of second speaker signal 908 (or, alternatively, the of band limited signal 933) may then be applied as a drive signal 938 to second speaker 912.

It is understood that the use of relational terms such as first and second, top and bottom, and the like, if any, are used to distinguish one from another entity, item, or action without necessarily requiring or implying any actual such relationship or order between such entities, items or actions. Much of the functionality and many of the principles are best implemented with or in software programs or instructions. It is expected that one of ordinary skill, notwithstanding possibly significant effort and many design choices motivated by, for example, available time, current technology, and economic considerations, when guided by the concepts and principles disclosed herein will be readily capable of generating such software instructions and programs with minimal experimentation. Therefore, further discussion of such software, if any, will be limited in the interest of brevity and minimization of any risk of obscuring the principles and concepts described herein.

As understood by those in the art, controller 204 includes a processor that executes computer program code to implement the methods described herein. Embodiments include computer program code containing instructions embodied in tangible media, such as floppy diskettes, CD-ROMs, hard drives, or any other computer-readable storage medium, wherein, when the computer program code is loaded into and executed by a processor, the processor becomes an apparatus for implementing the methods and apparatus described herein.

Embodiments of the various techniques described herein may be implemented in digital electronic circuitry, or in computer hardware, firmware, software, or in combinations of them. Embodiments may be implemented as a computer program product, i.e., a computer program tangibly embodied in an information carrier, e.g., in a machine-readable storage device or in a propagated signal, for execution by, or to control the operation of, data processing apparatus, e.g., a programmable processor, a computer, or multiple computers. A computer program, such as the computer program(s) described above, can be written in any form of programming language, including compiled or interpreted languages, and can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a communication network. Generally, a computer also may include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory may be supplemented by, or incorporated in special purpose logic circuitry.

Method steps may be performed by one or more programmable processors executing a computer program to perform functions by operating on input data and generating output. Method steps also may be performed by, and an apparatus may be implemented as, special purpose logic circuitry, e.g., an FPGA (field programmable gate array) or an ASIC (application-specific integrated circuit).

It will be appreciated that the above description for clarity has described various embodiments with reference to different functional units and processors. However, it will be apparent that any suitable distribution of functionality between different functional units or processors may be used. For example, functionality illustrated to be performed by separate processors or controllers may be performed by the same processor or controllers. Hence, references to specific functional units are only to be seen as references to suitable means for providing the described functionality rather than indicative of a strict logical or physical structure or organization.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the devices and methods described herein. Rather, the foregoing detailed description will provide those skilled in the art with a convenient road map for implementing exemplary embodiments. It being understood that various changes may be made in the function and arrangement of elements described in an exemplary embodiment without departing from the scope of the invention as set forth in the appended claims.

What is claimed is:

1. A hand-held electronic device, comprising:

an earpiece;

a first region and a second region remote from said first region;

a first speaker having a first primary audio output ported to said earpiece and a first bass reflex audio output;

a second speaker having a second primary audio output and a second bass reflex output, wherein said second bass reflex audio output is ported to said earpiece, wherein:

said first primary audio output is disposed proximate said second bass reflex audio output in said first region, and said second primary audio output is disposed proximate said first bass reflex audio output in said second region;

a sensor configured to sense a first position and a second position of said device;

a controller configured to drive said first and second speakers in a broadcast mode when said device is in said first position, and to drive said first and second speakers in a private mode when said device is in said second position, wherein said broadcast mode is substantially louder than said private mode; and a shutter configured to block said first bass reflex output when said device is in said broadcast mode.

2. The device of claim 1, wherein said earpiece is disposed in said first region.

3. The device of claim 1, wherein said broadcast mode is one of symmetric and stereophonic.

4. The device of claim 1, further comprising a display disposed between said first and second regions.

5. The device of claim 4, wherein said first position corresponds to a landscape viewing mode and said second position corresponds to a telephone mode.

6. The device of claim 1, wherein said sensor comprises a use case manager.

7. The device of claim 1, wherein:

said first speaker further comprises a first audio transducer and said second speaker further comprises a second audio transducer;

said first primary audio output is located on an output side of said first audio transducer and a first volume portion is located on a reflex side of said first audio transducer;

said second primary audio output is located on an output side of said second audio transducer and a second volume portion is located on a reflex side of said second audio transducer;

said first bass reflex audio port is connected to said first volume portion through a first conduit extending from said first region to said second region; and said second bass reflex audio port is connected to said second volume portion through a second conduit extending from said first region to said second region.

8. The device of claim 1, wherein:

said controller includes a filter and a polarity inverter;

said controller is configured to apply a first signal to said first speaker and a second signal to said second speaker; and said controller is configured to:

apply said first and second signals in phase to said first and second speakers, respectively, for all frequencies when said device is operating in said broadcast mode;

apply said first and second signals in phase to said first and second speakers, respectively, for all frequencies above a predetermined threshold when said device is operating in said private mode; and apply said first and second signals out of phase to said first and second speakers, respectively, for all frequencies below said predetermined threshold when said device is operating in said private mode, such that the primary output of the first speaker and the bass reflex output of the secondary speaker are in phase throughout the frequency range of interest for both speakers.

9. The device of claim 8, wherein said predetermined threshold generally corresponds to the resonant frequency of said first and second bass reflex outputs.

10. The device of claim 9, wherein said predetermined threshold comprises a range from about 200 to about 400 Hertz.

11. The device of claim 8, wherein said predetermined threshold is about 300 Hertz.

12. A handset comprising:

an earpiece;

a first region and a second region remote from said first region;

a first speaker having a primary output ported to said earpiece and having a first bass reflex audio output;

a second speaker having a second primary audio output and a second bass reflex output ported to said earpiece and tuned to a resonance frequency, wherein:

said first primary audio output is disposed proximate said second bass reflex audio output in said first region, and said second primary audio output is disposed proximate said first bass reflex audio output in said second region;

a sensor configured to sense a first position and a second position of said handset;

a controller configured to:

apply a signal to said second speaker, said signal having a high frequency component at a first phase and a low frequency component at a second phase, and drive said first and second speakers in a broadcast mode when said handset is in said first position, and to drive said first and second speakers in a private mode when said handset is in said second position, wherein said broadcast mode is substantially louder than said private mode; and a shutter configured to block said first bass reflex output when said device is in said broadcast mode.

13. The handset of claim 12, wherein said high frequency component is above said resonance frequency and said low frequency component is below said resonance frequency.

14. The handset of claim 13, wherein said resonance frequency is approximately 300 Hertz.

15. The handset of claim 12, further comprising a filter configured to limit said signal to within the range of said resonance frequency.

16. A method of porting audio signals to an earpiece of a telephone operating in private mode, comprising:

applying, in a first region, a primary audio output of a first speaker to said earpiece;

applying a bass reflex audio output of a second speaker to said earpiece said second speaker disposed in a second region remote from said first region, wherein said primary audio output of the first speaker is disposed proximate said bass reflex audio output of said second speaker in said first region;

applying a first electronic signal to said first speaker;

applying a second electronic signal to said second speaker, said second electronic signal having a first frequency component at a first phase, and a second frequency component at a second phase which is inverted with respect to said first phase, such that the primary output of first speaker and the bass reflex output of the secondary speaker are in phase throughout the frequency range of interest for both speakers;

sensing a first position and a second position of said telephone; driving said first and second speakers in a broadcast mode when said telephone is in said first position, and to drive said first and second speakers in a private mode when said telephone is in said second position, wherein said broadcast mode is substantially louder than said private mode; and blocking a bass reflex output of said first speaker.

* * * * *